US005626389A

United States Patent [19]

Logan, Jr.

[11] Patent Number: 5,626,389

[45] Date of Patent: May 6, 1997

[54] LIFT SEAT

[75] Inventor: Emanuel Logan, Jr., Columbia, Md.

[73] Assignee: Dynamic Seating LLC, Washington, D.C.

[21] Appl. No.: 379,658

[22] PCT Filed: Aug. 10, 1993

[86] PCT No.: PCT/US93/07476

§ 371 Date: Feb. 9, 1995

§ 102(e) Date: Feb. 9, 1995

[87] PCT Pub. No.: WO94/03087

PCT Pub. Date: Feb. 17, 1994

Related U.S. Application Data

[63] Continuation-in-part of Ser. No. 926,430, Aug. 10, 1992, Pat. No. 5,312,157, and a continuation-in-part of Ser. No. 702,387, Feb. 20, 1991, abandoned.

[51] Int. Cl.[6] ..... A47C 1/08

[52] U.S. Cl. ..... 297/250.1; 297/DIG. 10

[58] Field of Search ..... 297/250.1, DIG. 10, 297/313; 4/237, 238, 240, 241

[56] References Cited

U.S. PATENT DOCUMENTS

| | | | |
|---|---|---|---|
| 1,570,436 | 1/1926 | Dawson | 297/313 X |
| 3,473,174 | 10/1969 | Cool | 297/DIG. 10 X |
| 3,640,566 | 2/1972 | Hodge | 297/DIG. 10 X |
| 4,538,853 | 9/1985 | Levenberg | 297/DIG. 10 X |
| 4,587,678 | 5/1986 | Love et al. | 297/DIG. 10 X |
| 4,884,841 | 12/1989 | Holley | 297/DIG. 10 X |
| 4,938,533 | 7/1990 | Thielois | 297/DIG. 10 X |
| 5,011,224 | 4/1991 | Paul | 297/DIG. 10 X |
| 5,309,583 | 5/1994 | White et al. | 297/DIG. 10 X |
| 5,312,157 | 5/1994 | Logan, Jr. | 297/250.1 |
| 5,316,370 | 5/1994 | Newman | 297/DIG. 10 X |

*Primary Examiner*—Jose V. Chen

[57] ABSTRACT

A lift seat includes a seating surface, for example, a toilet seat, mounted on a supporting frame by a four-bar linkage. The four-bar linkage includes a lower link fixed to the frame and an upper link fixed to the seat. An armrest is attached to a front link of the four-bar linkage for pivoting therewith against the bias of the spring which loads the four-bar linkage as the seat is lowered from a raised position in a seating position. Energy stored in the spring is then available to lift the person from the seating position back to the raised position. A damper is connected to the four-bar linkage to prevent abrupt movement of the seat as the four-bar mechanism collapses and expands, while a gas spring is provided to initially resist movement of the four-bar linkage from either the expanded or the collapsed condition unless the armrest is initially rotated.

5 Claims, 15 Drawing Sheets

LIFT SEAT

CROSS-REFERENCE TO RELATED APPLICATIONS

This application is a continuation-in-part application of U.S. application Ser. No. 07/926,430, filed Aug. 10, 1992, now U.S. Pat. No. 5,312,157 which application is designated as a U.S. National Phase under PCT/US93/07476, filed 10 Aug. 1993, and is a continuation-in-part of parent application Ser. No. 07/702,387, filed 20 Feb. 1991 now abandoned.

BACKGROUND OF THE INVENTION

1. Field of the Invention

The instant invention relates to devices for assisting infirm or injured individuals to move from a standing position to a sitting position and from a sitting position to a standing position. More particularly, the instant invention is directed to improvements chairs and toilet seats which are configured to assist infirm individuals in lowering themselves to and raising themselves from the sitting position.

2. Prior Art

The patent literature includes numerous arrangements for assisting infirm individuals in sitting down and standing up from a chair or toilet seat.

U.S. Pat. No. 4,538,853 discloses a chair with a resilient mechanism for assisting an occupant in raising him- or herself to a standing position. The chair is provided with a seat cushion which pivots relative to the chair frame about an axis near the rearward edge of the frame. The movement also serves to at least simultaneously partially elevate an armrest. When the chair is occupied, resilient struts are compressed to store energy for lifting the occupant. The seat may be manually locked in its lowered position.

U.S. Pat. No. 3,975,051 discloses an orthopedic chair which includes a movably supported frame assembly which serves to maintain a forwardly and downwardly extending saddle-shaped seat at a desired elevation between a pair of laterally spaced sidewalls and a backrest. The chair of this patent utilizes footrests and relies on electricity for its operation.

U.S. Pat. No. 3,473,174 discloses a power-driven, tilted seat in which the seat and associated armrests are fixed relative to one another and move with respect to a supporting frame. Power-actuated hydraulic cylinders are used to raise and lower the seat. U.S. Pat. No. 4,587,678 to Love also relies on an electrically driven hydraulic lift. However, in this patent, the armrests are fixed with respect to the frame, and only the seat moves.

U.S. Pat. No. 4,907,303 discloses an orthopedic chair with a spring-loaded seat, wherein a coil spring is tensioned as a user sits in the seat in order to store energy where it is subsequently used to assist in lifting the user to his or her feet when he or she wishes to stand.

A hand brake grips a cable attached to the spring to control application of the spring's force to the seat.

Each of the above-discussed patents are exemplary of prior art approaches to the problem of providing chairs and seats for the infirm. However, none of these seats discloses arrangements wherein a seat not requiring auxiliary power functions effectively for people over a wide range of heights and weights while effectively utilizing ergonomic principles in its design and operation to provide convenience, comfort, and security for its users.

SUMMARY OF THE INVENTION

In view of the aforementioned object, the instant invention contemplates a lift seat for moving a person from an initial raised position to a subsequent lowered position for sitting and thereafter back to the initial raised position to facilitate standing. The lift seat comprises a seating surface upon which the person sits and applies a force; a frame for supporting the seating surface, and a four-bar linkage having a lower link, an upper link, a front link, and a rear link with the front and rear links pivoted to the upper and lower links, the lower link being secured to the frame and the upper link being attached to the seating surface; an armrest for supporting the person using the seat and for initiating operation of the seat. The armrest being secured to one of the links pivoted to the upper and lower links. A spring device is coupled to the four-bar linkage and frame for resisting lowering of the seating surface from the raised to the lowered position and for storing energy provided by the weight of the person sitting on the seat for subsequently lifting the person from the lowered to the raised position.

BRIEF DESCRIPTION OF THE DRAWINGS

Various other objects, features, and attendant advantages of the present invention will be more fully appreciated as the same becomes better understood when considered in conjunction with the accompanying drawings, in which like reference characters designate the same or similar parts throughout the several views and wherein.

DETAILED DESCRIPTION

Figure 1:
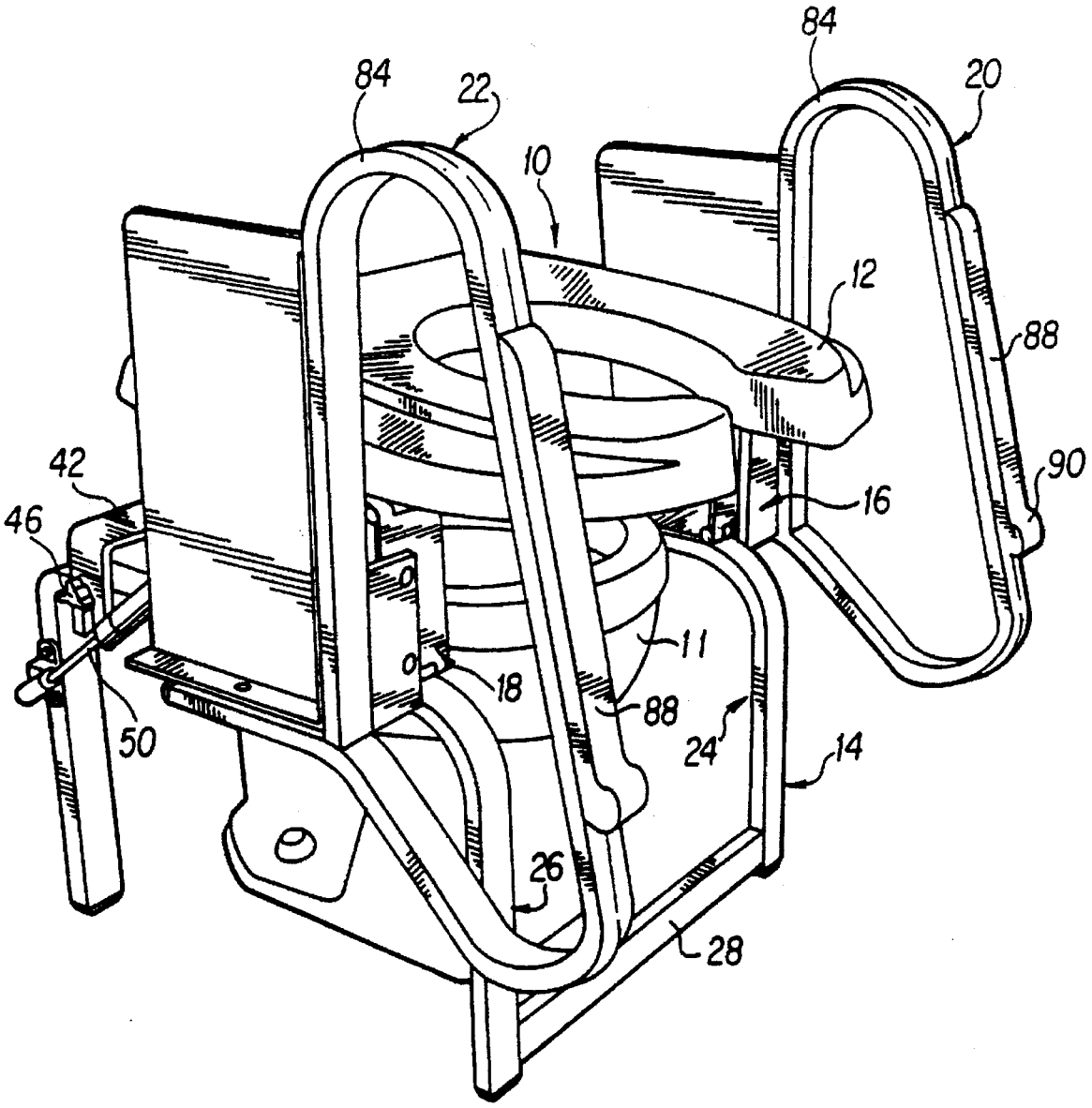
FIG. 1 is a perspective view of a lift seat in the form of a toilet seat configured in accordance with the principles of the instant invention.
Figure 2:
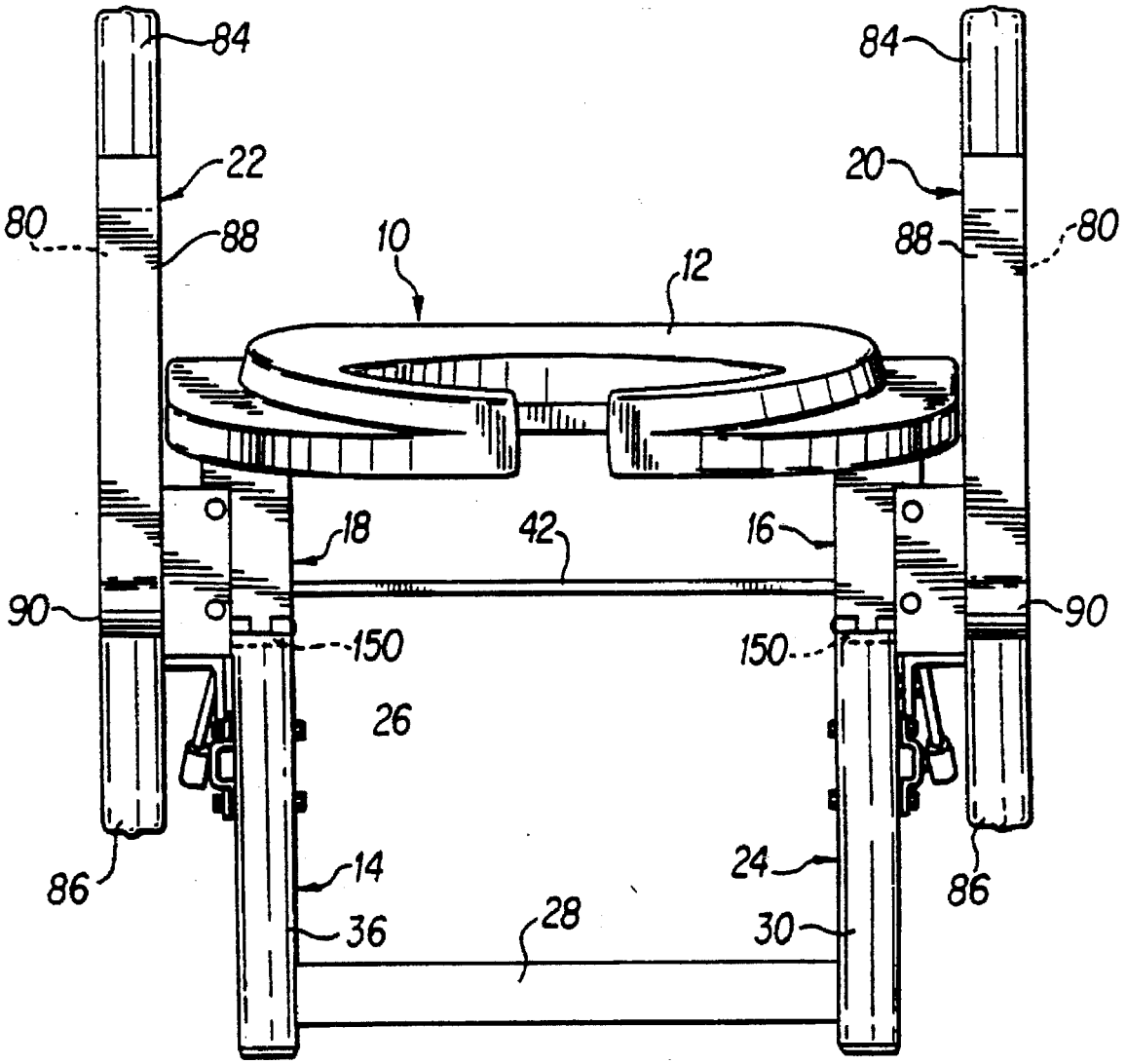
FIG. 2 is a front view of the lift seat of FIG. 1.

Referring now primarily to FIGS. 1–5, there is shown a lift seat, designated by the numeral 10, configured in accordance with the principles of the instant invention. In the illustrated embodiment, the lift seat 10 is positioned over a toilet bowl 11 and includes a toilet seat 12, which is mounted on a frame, designated generally by the numeral 14, by a first and second four-bar linkages, designated generally by the numerals 16 and 18. The four- bar linkages 16 and 18 are Joined to one another by a rigid strut 19 so that the four-bar linkages move in concert with one another. A first armrest, designated generally by the numeral 20, is fixed to the first four-bar linkage 16, and a second armrest, designated by the numeral 22, is fixed to the second four-bar linkage 18. The four-bar linkages 16 and 18 are coupled to one another by a rigid strut 19 so as to collapse and expand in concert.

Figure 4:
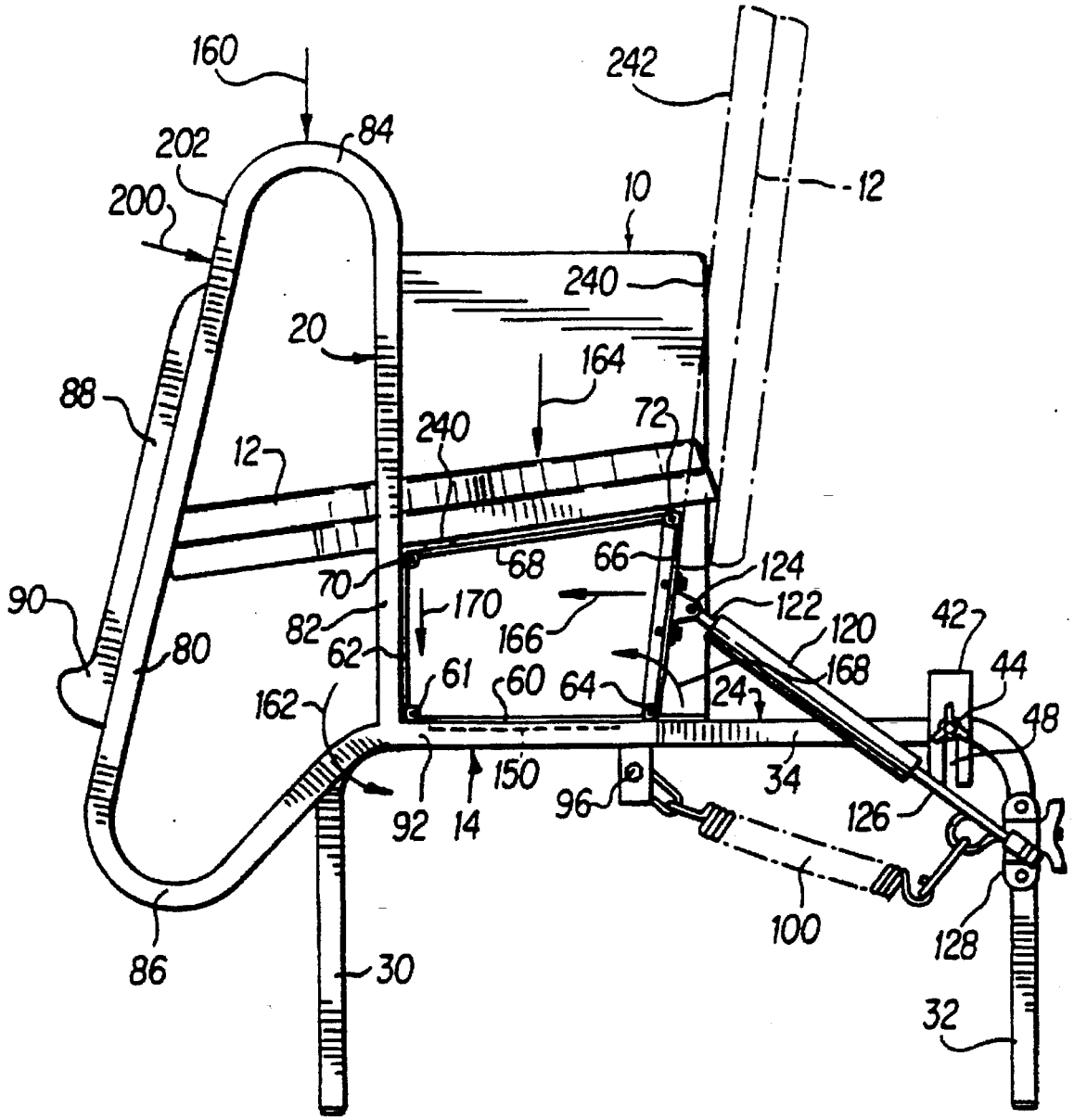
FIG. 4 is a side view of the lift seat of FIG. 1, showing the lift seat in its raised position with the pivoted toilet seat shown in phantom.
Figure 5:
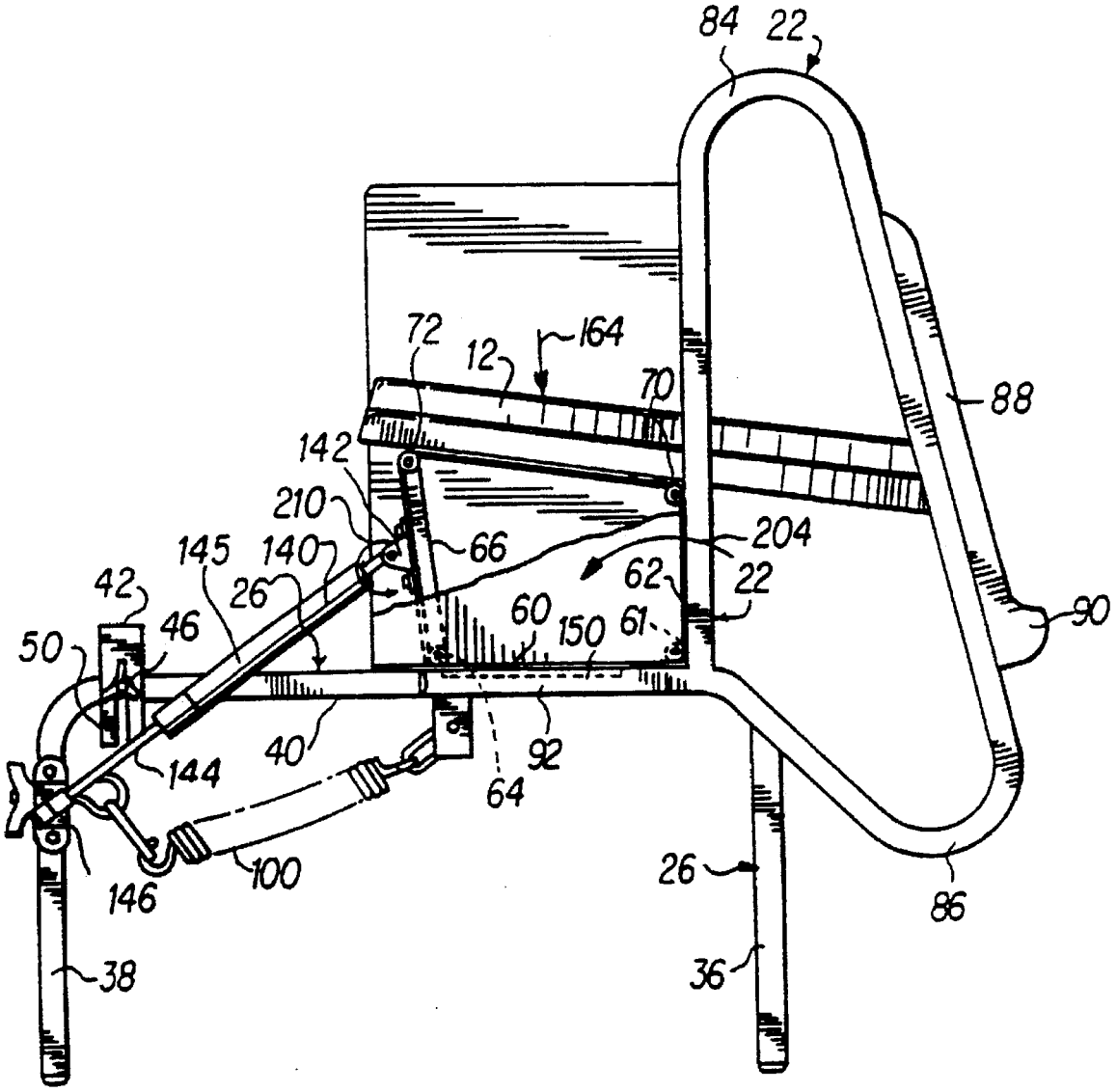
FIG. 5 is a side view of the lift seat viewed from the opposite side from FIG. 4.
Figure 6:
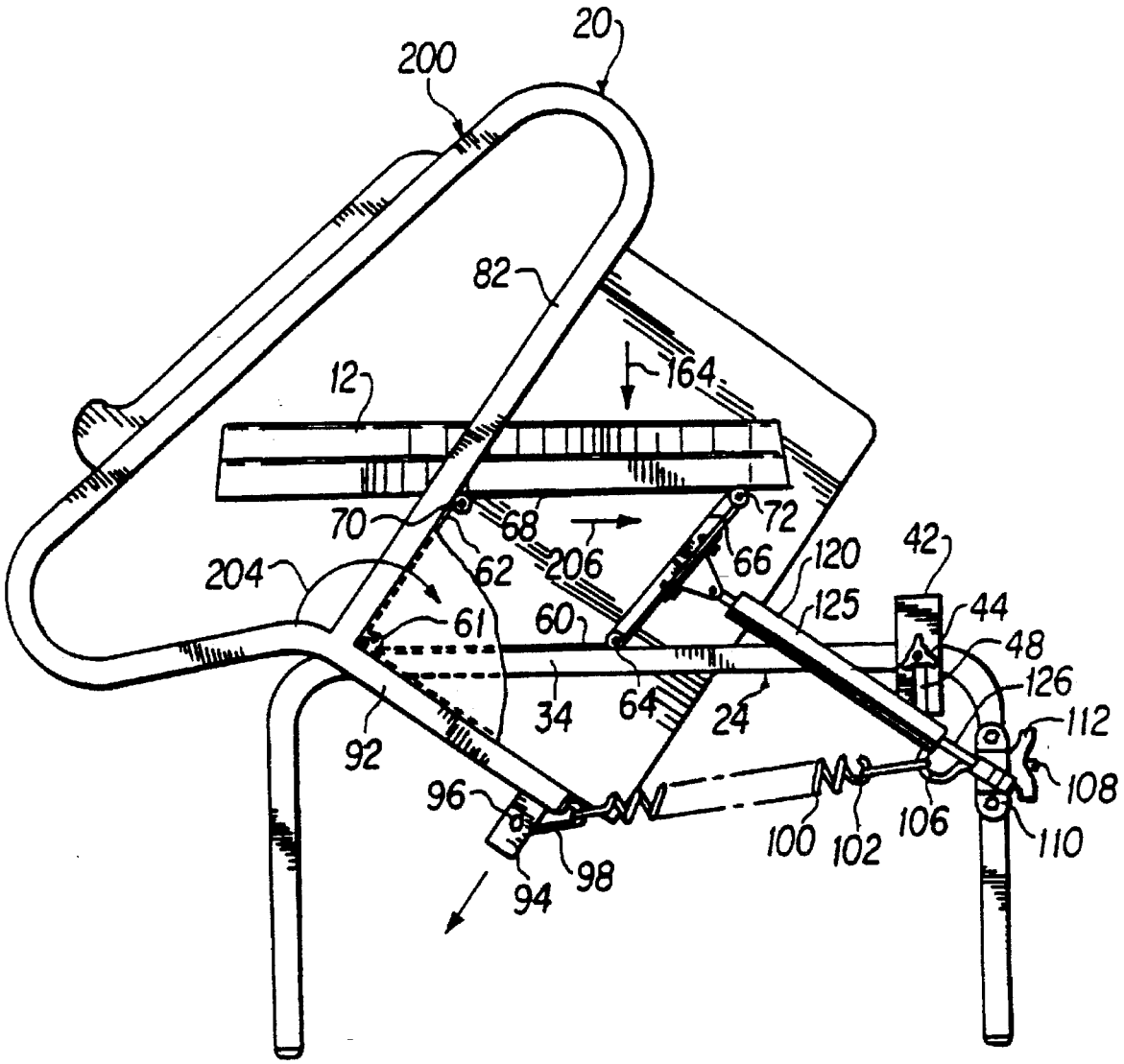
FIG. 6 is a side view taken from the same side as FIG. 4, showing the lift seat collapsing to its lowered position.
Figure 7:
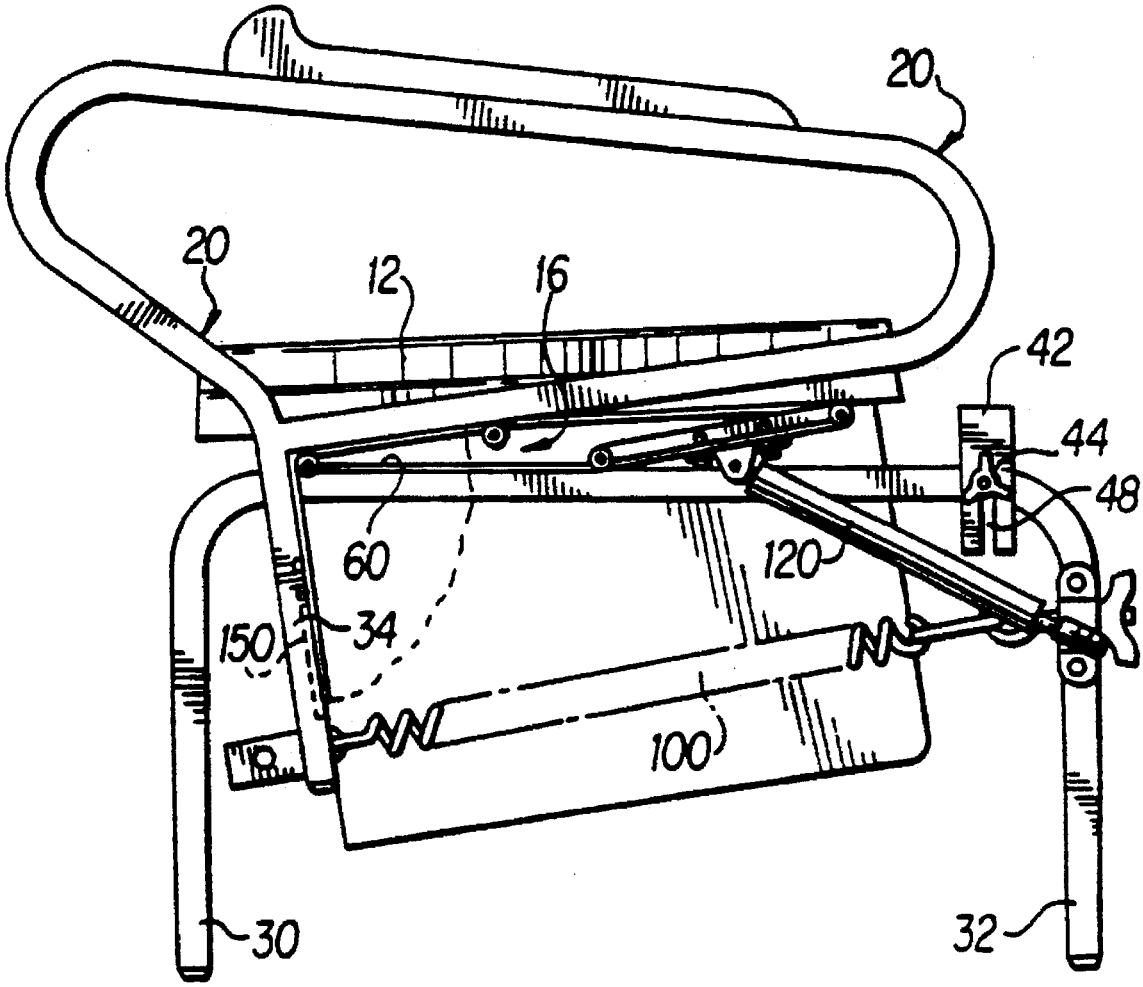
FIG. 7 is a side view taken from the same side and FIGS. 4 and 6, showing the lift seat in its lowered position.

In operation, the toilet seat 12 is lowered from its raised position shown in FIGS. 1–5 through an intermediate mode shown in FIG. 6 to a lowered position shown in FIG. 7. As the toilet seat 12 is lowered from its raised position to its lowered position of FIG. 7, the four-bar linkages 16 and 18 collapse.

The various elements of the lift seat 10 cooperate to provide a safe and convenient device which facilitates lowering an infirm person from a standing to a sitting position. In the illustrated embodiment, the lift seat 10 is utilized with a toilet seat 12, however, the lift seat 10 may be used for any type of chair.

The support frame 14 is rigid and is formed of first and second pairs of U-shaped leg supports 24 and 26 connected by a front brace 28. The first leg support 24 is shown in the side view of FIG. 4 and comprises a front leg 30 and a rear leg 32 joined by a beam 34. The second leg support 26 is shown in- the side view of FIG. 5 and comprises a front leg 36, joined to a rear leg 38 by a beam 40. The strut 28 joins only the front legs 30 and 36 proximate the floor upon which the support frame 14 rests so that the toilet bowl 11 may be received between the rear legs 32 and 38. A U-shaped connecting bar 42 is connected to the first and second beams 34 and 40 of the U-shaped leg supports 16 and 18 by thread bolts 44 and 46, which are received in slots 48 and 50 in the ends of the U-shaped bar 42. The U-shaped bar 42 includes a pair of slots 52 and 56, which receive the bolts which normally retain the toilet seat (not shown) ordinarily associated with the toilet bowl 11.

Figure 3:
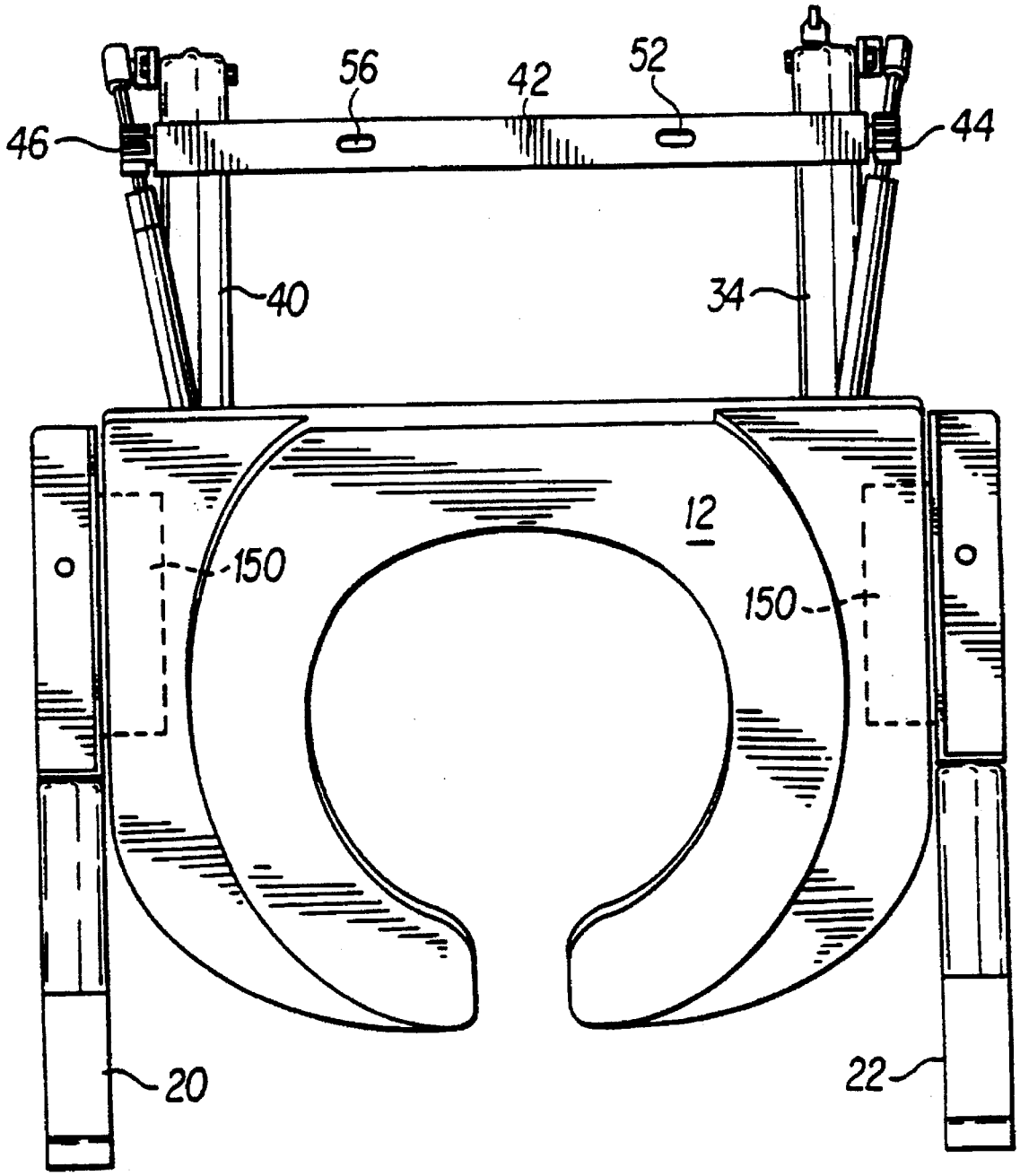
FIG. 3 is a top view of the lift seat of FIG. 2.

Referring now mainly to the side view of FIGS. 4–10, the four-bar linkages 16 and 18 disposed between the toilet seat 12 and the frame 14 each include base links 60, which are fixed to the bars 34 and 40 of the U-shaped leg supports 24 and 26. Pivoted by pivots 61 to the front ends of the base links 60 are front links 62, which are fixed to the armrests 20 and 22. Pivoted to the rear end of the base links 60 by pivots 64 are rear links 66, which cooperate with the front links 62 to determine the height and attitude of the toilet seat 12. The front links 62 are pivoted to top links 68 by hinges 70, while the rear links 66 are pivoted to the top links 68 by hinges 72. The toilet seat 12 is fixed to the top links 68, but, as seen in FIG. 3, the toilet seat pivots to the phantom position with respect to the top links 68. The armrests 20 and 22, which are bolted or otherwise fixed to the front links 62 of the four-bar linkages 16 and 18, each includes an upper rail 80 and a lower rail 82, which is joined to the upper rail by U-shaped portions 84 and 86. Fixed to the top rails 80 are grips 88, each having a raised hand-stop portion 90. When the seat is in its lowered position, as shown in FIG. 7, the grips 88 are horizontal. Depending from the lower rail 82 and rigid with respect to the armrest structures are struts 92, each of which has a lug 94 thereon, with a eyelet 96 retaining a loop 98 for connecting a coil spring 100 thereto. In the preferred embodiment, a coil spring 100 is attached only to the strut 92 of armrest 20. A second end 102 of the spring 100 is attached to a loop 104 which, in turn, is secured to a hook 106. The hook 106 has a threaded shank 108 which passes through the rear leg 32 of the U-Shaped leg support 24. A nut 112 on the shank 108 is used to adjust the tension on coil spring 100. As is seen in FIGS. 4 and 5, the coil spring 100 is untensioned when the toilet seat 12 is in its raised position. It only becomes tensioned after a person sits on the seat 12 and seat lowers, as is seen in FIG. 6.

While in the raised position of FIG. 4, the seat 12 is held biased to its fully raised position by a gas spring 120, which has a projecting rod 122 pivoted to a bracket 124 fixed on the rear link 66 and a piston rod 126 pivoted on a bracket 128 mounted on the rear leg 32 of the U-shaped support leg 24. In the preferred embodiment of the invention, only a single gas spring 120 is used in conjunction with the coil spring 100.

Secured to the other rear link 66 (FIG. 5) is a damper 140, the cylinder of which is pivoted to a bracket 142 affixed to the rear link 66 and a piston rod 144 of which is pivoted to a bracket 146 fixed on the rear leg 38 of the U-shaped leg support 26.

The gas spring 120 holds the four-bar linkages 16 and 18 in the expanded position of FIGS. 1–4 by causing flanges (dotted lines 150), which are fixed to struts 92, to engage bottom surfaces of the base links 60. In this way, the four-bar linkages 16 and 18 are normally prevented from collapsing in the forward or rearward direction against the bias of the gas spring 120, the coil spring 100, and the damping strut 140.

In operation, when the user approaches the lift seat 10, the user may support him- or herself by grasping the U-shaped connecting portions 84 of the armrests 20 and 22 while facing the lift seat.

When in this position, the user applies force to the armrests in the direction of arrow 160. This induces torque in the armrests 20 and 22 in the direction of arrow 162 about pivot point 61. The torque in the direction of arrow 162 causes the flanges 150 extending inwardly from the strut 92 to abut the base link 60, providing a rigid, stable support for the person facing the lift seat 10 When the person turns around and faces away from the lift seat 10, the person can still support himself on the U-shaped connecting position 80. When one sits on the seat 12 while the seat is in the raised position of FIGS. 1–5, the seat does not initially sink toward its lowered position of FIG. 7 but, rather, remains in the raised position. This is because the four-bar linkages 16 and are prevented from collapsing due to the gas spring 120 and the damping strut 140 holding the rear links 66 in the expanded position in which the vertical component induced in the four-bar linkages 16 and 18 by a person's weight applied in the direction of arrow 164 tends to pull the rear link 66 forward in the direction of arrow 166. In other words, the force 164 of the person's weight tends to rotate the rear link 66 about the pivot 64 in the counterclockwise direction in FIG. 3, exemplified by the arrow 168. These forces are applied through the top link 68 and downwardly in the direction of the arrow 170 in the front link 62, which links 62 are fixed to the bottom rail 82 of the armrests 20 and 22. The armrests 20 and 22 tend to rotate in the direction of arrow 162 and press the stop plate 150 against the bottom of base link 60 as long as force is applied with a resultant component in the direction of arrow 60. This is, however, a fine balance, which, as will be explained hereinafter, is easily overcome by the person sitting on the toilet seat 12 or by a helper.

In order to lower the seat 12 with a person sitting thereon, the person overcomes the static relationship established by the four-bar linkages 16 and 18 by applying a slight force in the direction of arrow 200 (see FIG. 4). This is accomplished by simply moving one's hand forward on the U-shaped connecting portion 84, applying a very slight pressure at an area 202 on the rail 80. As is best seen in FIG. 6, this slight pressure causes the armrests 18 and 20 to pivot in the direction of arrow 204 about pivot point 61. Since the bottom rails 82 are fixed to the front link 62 of the four-bar linkages 16 and 18, a force in the direction of arrow 206 is applied through the upper links 68. This force 206 tends to shift the force component 164 (see also FIG. 4) provided by the user's weight slightly over center with respect to the gas spring 120 so that instead of the gas spring 120 being pulled to extend (which the gas spring cannot do), the gas spring is moved slightly over center so that it is positioned by the rear link 66 to collapse under the force 164 of the person's weight. When the gas spring 120 is positioned to collapse, the piston rod 126 slides into the cylinder, compressing gas in the cylinder 125 and storing that energy in the gas spring for subsequent use.

The damper 140 (see FIG. 5) is positioned on the opposite side of the chair, as shown in FIGS. 4 and 6, and initially operates in substantially the same fashion as the gas spring 120. In other words, the damper 140 initially holds the rear link 66 in a position such that the weight component 164 of the person sitting on the toilet seat 12 pulls the damper in extension. Again, when the armrest 22 is rotated in the direction of arrow 204 (also see FIG. 6) about the pivot 61, the damper 140 is rotated slightly in the direction of arrow 210 so as to go over center and allow the weight of the person on the seat 12 to collapse the damper so that the piston on the end of piston rod 144 slides into the cylinder 145.

As is seen in FIGS. 4 and 5, the coil spring 100 is initially slack. However, as the four-bar linkages 16 and 18 begin to collapse, the coil spring 100 is tensioned, as is seen in FIG. 6. The coil spring 100 thereafter resists rotation of the armrests 20 and 22 in the direction of the arrow 204 and stores the energy imparted by force component 164 due to the weight of the person sitting on the seat 12. When the seat 12 reaches its completely collapsed position, as shown in FIG. 7, the spring 100 has stored a substantial portion of the energy imparted by the person sitting on the seat 12. This partial energy is available to help lift the person back to the standing 10 position. While the coil spring 100 is completely tensioned in FIG. 7, the gas spring 120 is again over center, only this time, it is exerting a force tending to keep the four-bar linkages 16 and 18 collapsed. This provides a slight force which must be overcome in order to feed the energy of the spring 100 back into the system to start rotation of the armrest 120 in the direction 220, as shown in FIG. 8.

Figure 8:
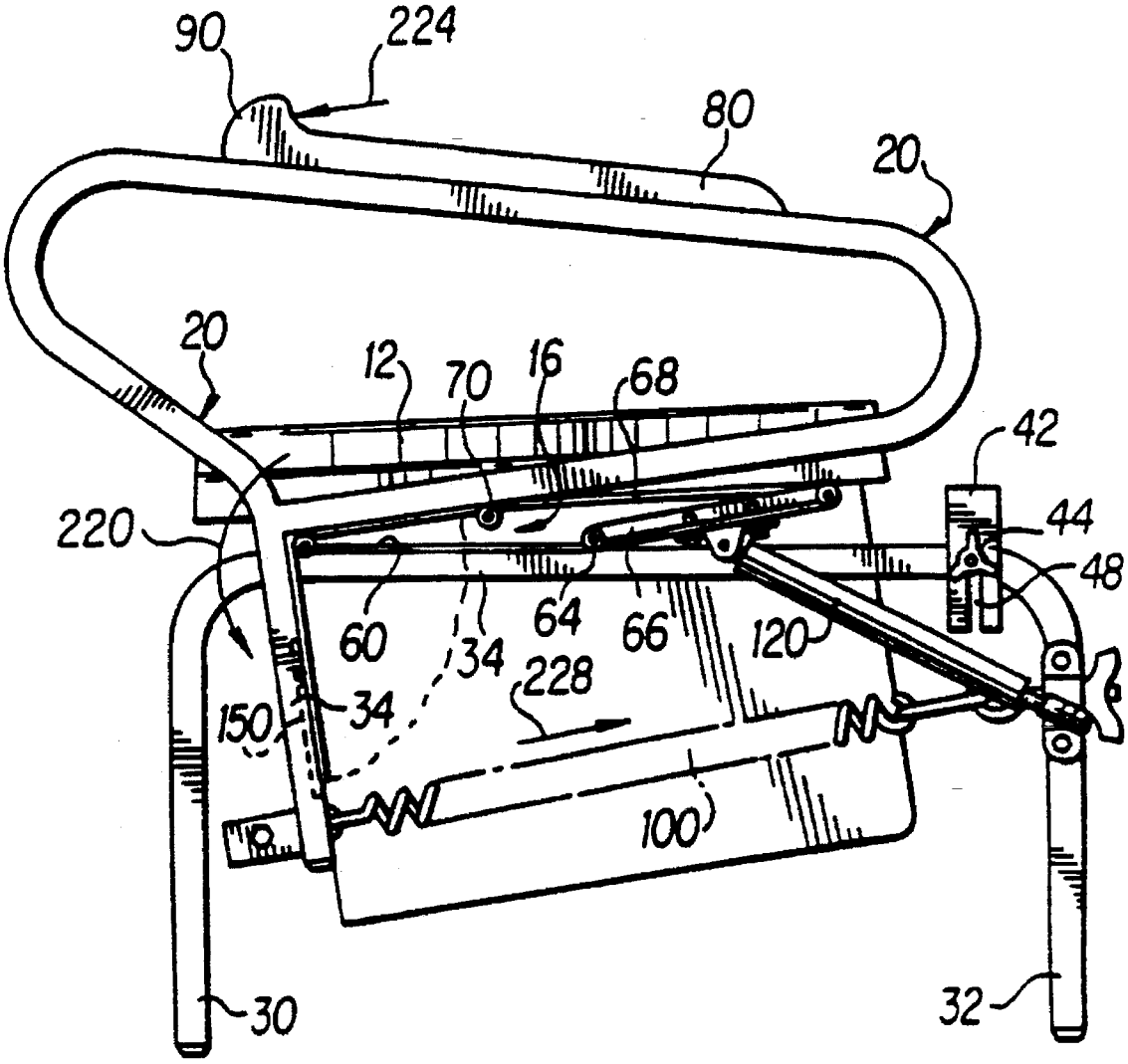
FIG. 8 is a side view similar to FIG. 7 showing initial forces necessary to raise the seat.
Figure 9:
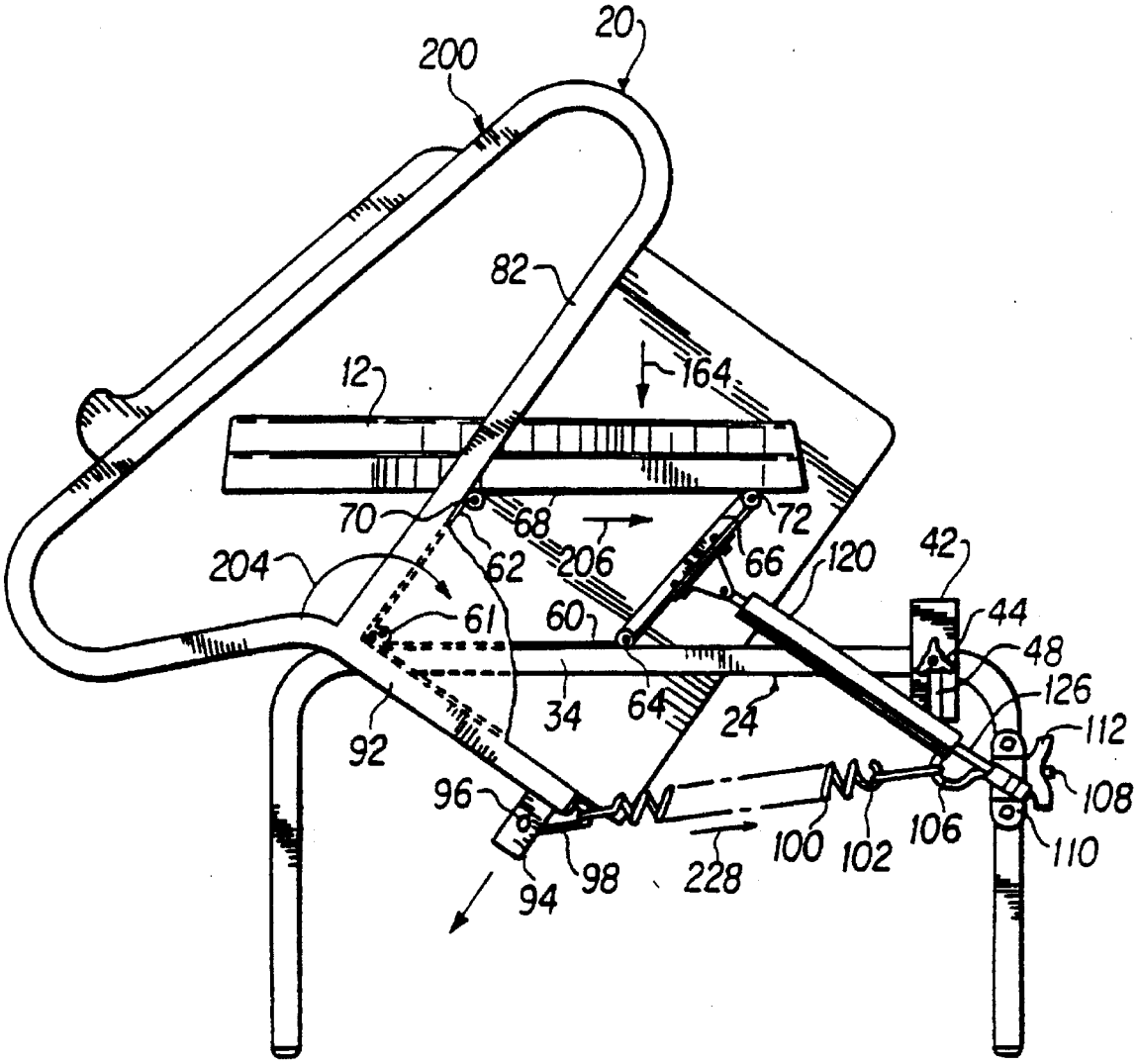
FIG. 9 is a side view showing the seat rising to lift its occupant to a raised position which-facilitates standing.
Figure 10:
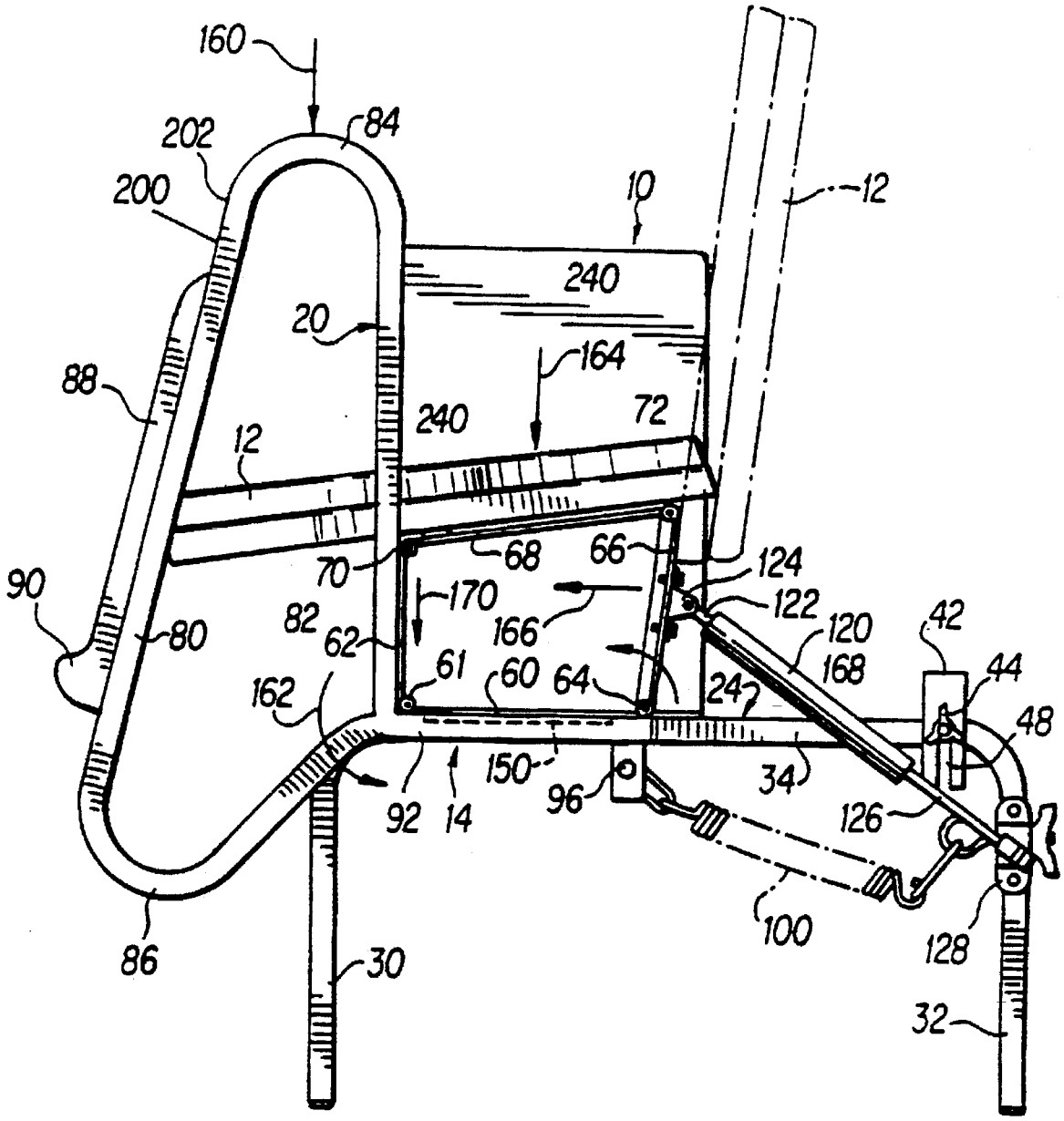
FIG. 10 is a side view showing the seat in its raised position.

Referring now more particularly to FIGS. 8, 9, and 10, when the person wishes to stand up, a slight force 224 is applied against the projections 90 on the grips 88 to start the armrests 20 and 22 rotating in the direction of arrow 220. This initially slightly lifts the front link 62 which, in turn, pulls the top link 68 via the connection provided by the hinge 70. The tension in top link 68 causes the rear link 66 to begin rotating about the hinge 64 which, in turn, lifts the upper end of gas sparing 120 over center so that the gas spring 120 now applies its force to expand the four-bar linkage 16 rather than to collapse the four-bar linkage 16. The coil spring 100 is already applying a force in the direction of arrow 228, which force is added to that of the gas spring 120. The user then leans slightly forward to shift his or her weight slightly forward, and the energy stored in coil spring 100 and gas spring 120 lifts the seat 12 with the person sitting thereon smoothly through the intermediate position of FIG. 9 to the final position of FIG. 10, a position from which the person can easily stand.

In order to prevent the springs 100 and 120 from applying their force too rapidly, the damper 140 (see FIG. 5) resists rapid movement of the rear links 66 from the FIG. 8 position through the FIG. 9 position to the FIG. 10 position.

As is seen in FIG. 4, the toilet seat 12 has a pair of pads 240 on the bottom surface 242 thereof. The pads 240 abut the top surface of the top link 68 in the four-bar linkages 16 and 18. The attitude or angular orientation of the seat 12 with respect to the horizontal can, therefore, be controlled to lift the seat slightly so as to accommodate taller individuals or so as to lower the seat. Since the seat 12 is pivoted on the upper links 68, adjustment of its height by determining the angle that it forms with the upper links is easily accomplished by lifting the seat up and changing the thickness of the pads 240.

By the interaction and cooperation of the gas spring 120, the coil spring 100, and the damper 140 with the four-bar linkages 16 and 18 joined by the strut 19, the toilet seat 12 moves between its raised and lowered position with a smooth, unabrupt motion. The armrests 20 and 22 allow the person using the seat to initially brace him- or herself and then to initiate lowering and raising of the toilet seat 12 by exerting minimal effort. A lift seat is, therefore, provided which assists infirm individuals in both standing and sitting.

Figure 11:
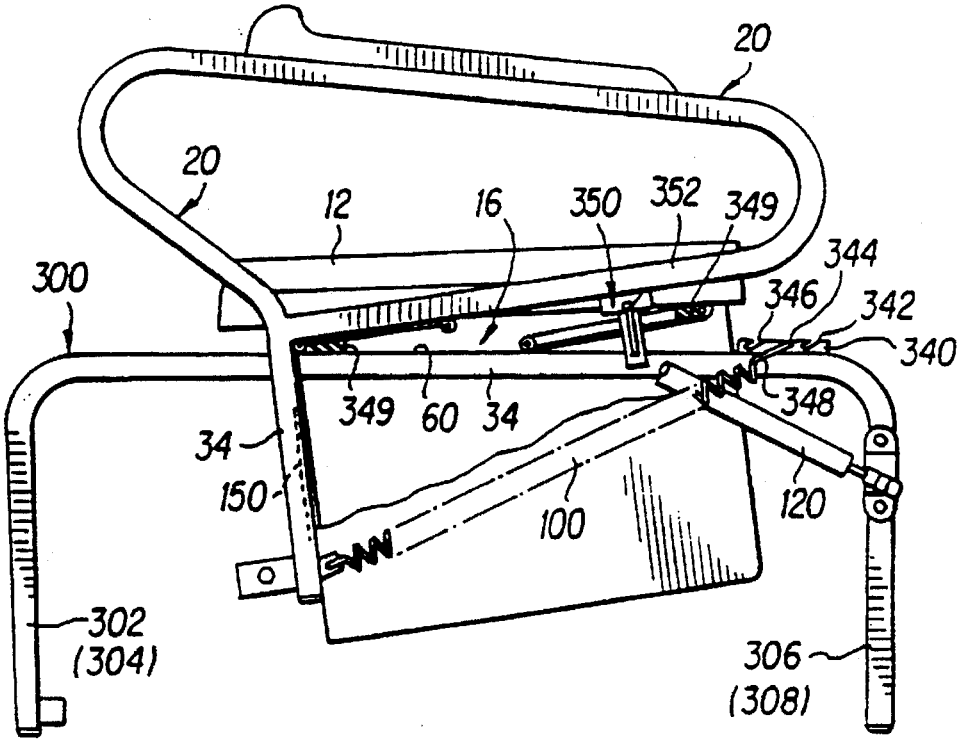
FIG. 11 is a side view of an evolved embodiment of the invention illustrating a preferred anchoring of a coil spring, increased spacing between the front and rear legs and a latch for holding the seat in its lowered position.

Referring now to FIGS. 11–17, there is shown an evolved embodiment of the instant invention wherein the original lift seat 10, now designated by the general reference numeral 300, is configured so as to be suitable for bedside use as well as for use with a toilet 11 (see FIG. 1). In the embodiment of FIG. 11, the front legs 302 and 304 and rear legs 306 and 308 are spaced further apart than in the embodiment of FIGS. 1–10. In the embodiment of FIGS. 1–10, the pair of front legs 30 and 38 and the pair of rear legs 32 and 36 are spaced about 20½ inches apart whereas, in the embodiment of FIGS. 11–16, the pair of front legs 302 and 304 are spaced about 25½ inches from the pair of rear legs 306 and 308. This provides a more stable Support for the lift seat 300 so that the lift seat 300 is readily used with or without the toilet 11. In the embodiment of FIG. 11, the bar 42 is no longer necessary since it is not necessary to bolt the lift seat 300 to a toilet in order to have a stable lift seat.

Figure 16:
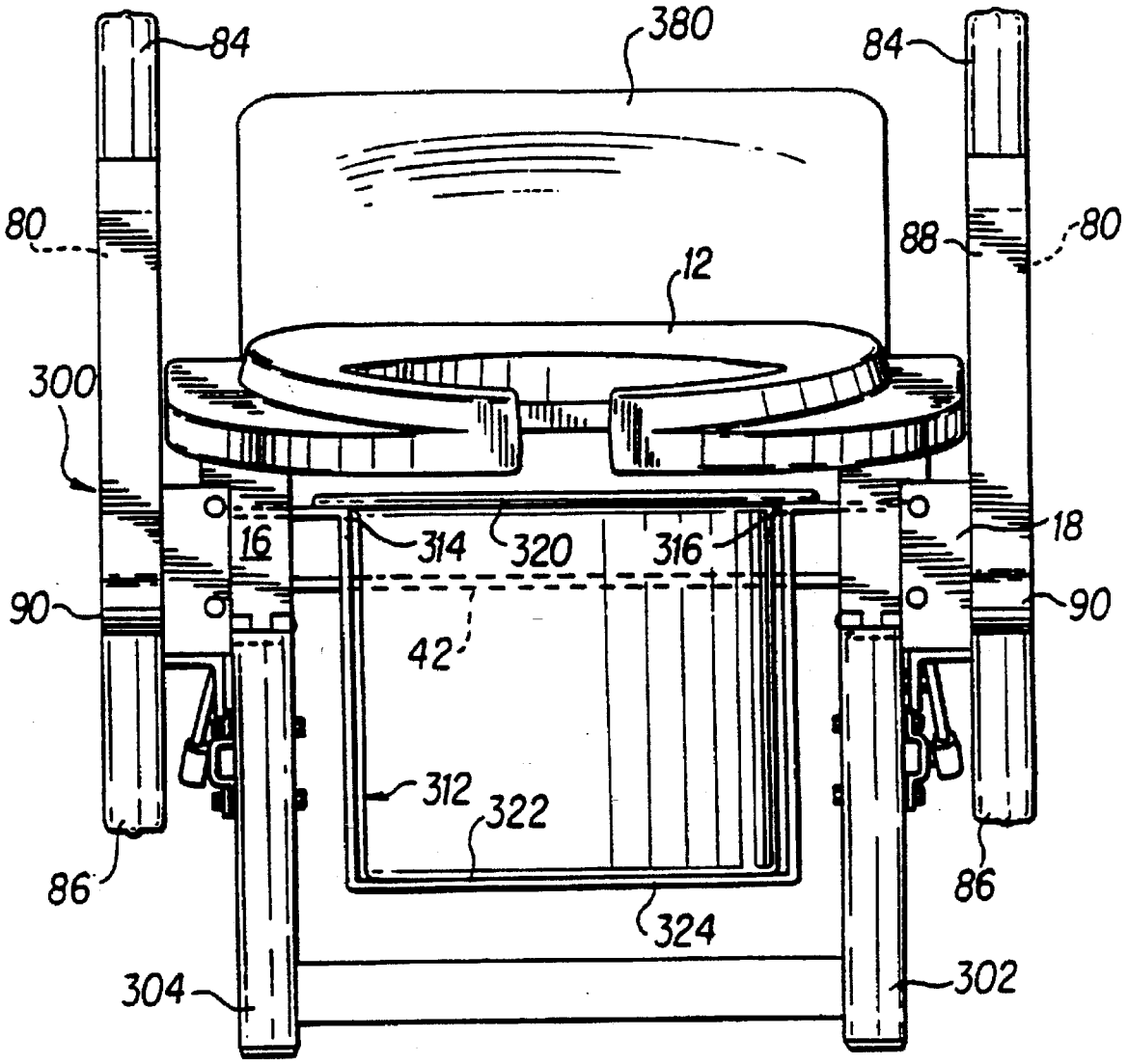
FIG. 16 is a front view of the lift seat illustrating a bucket attachment and bucket for bedside use as well as an optional back rest.
Figure 17:
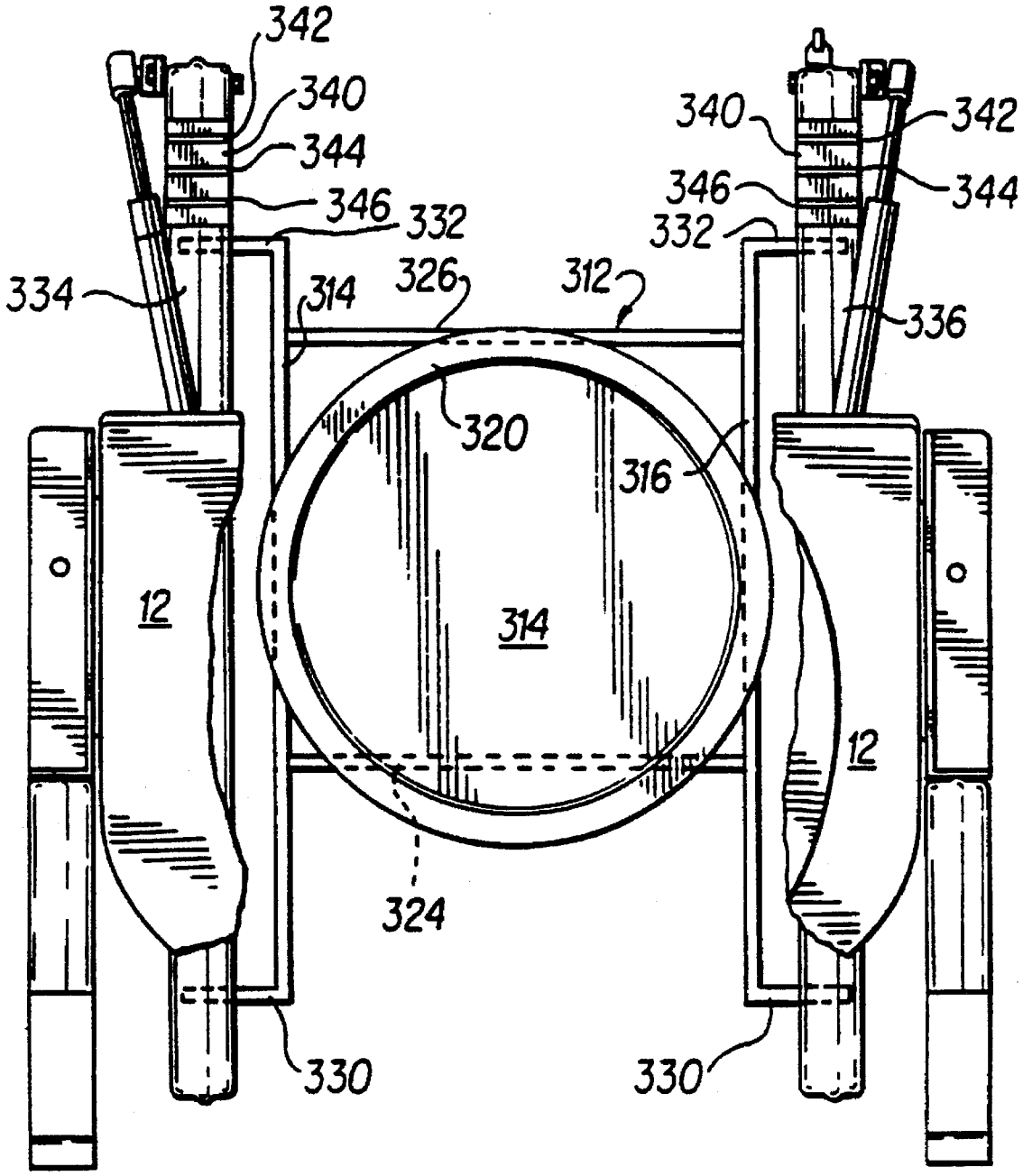
FIG. 17 is a top view of the lift seat of FIGS. 11 and 16 showing the bucket installed.

Referring now to FIGS. 16 and 17, it is seen that a bucket 310 is supported beneath the toilet seat 12 by a plastic covered wire bracket 312. The plastic covered wire bracket 312 has portions 314 and 316 which fit beneath an annular lip 320 of the bucket 310. The wire bracket 312 also has a U-shaped portion 322 which has a cross-piece 324 that fits beneath the bucket 310 to support the bucket from the bottom while a cross-piece 326 underlies the lip 320 to support the bucket at the top. Front and rear struts 330 and 332 engage with the side frame members 334 and 336 to support the bracket 312. The bracket 312 is readily removable when one needs to utilize the lift seat with a toilet such as the toilet 11 of FIG. 1.

In the embodiment of FIGS. 11, 16 and 17, two coil springs 100 are utilized, one positioned on each side frame 24 and 26 of the lift seat 300 whereas in the embodiment of FIGS. 1–10 only a single coil spring 100 is used.

As is seen in FIGS. 11 and 17, the horizontal cross-pieces 334 and 336 joining the legs of the seat 300 each have a spring anchor 340 thereon. The spring anchors 340 each have three slots 342, 344 and 346 therein. Received in one of the slots of each anchor 340 is a rectangular loop 347 which is attached to ends 348 of the springs 100.

In order to prevent the four-bar linkages 16 and 18 from collapsing completely, triangular blocks 349 are inserted between the four-bar linkages 16 and 18.

In the embodiment of FIGS. 11–17, the additional features of having the block 340 for adjusting the tension on two springs 100, placing the front legs 302 and 304 a further distance from the rear legs 306 and 308, as well as providing bracket 312 to support the bucket 314, enhance the lift seat 300 to make it even more responsive to patients of various weights and to allow bedside use wherein bucket 314 can be used. As is seen in FIG. 16, a back rest 380 may be added to the toilet seat 12.

The latch 350 of FIGS. 11–15 enables the caregiver or nurse to keep the patient seated until the nurse or caregiver is ready for the patient to rise. Having the disclosed latch 350 provides a degree of complexity so that an infirm patient may have difficulty unlatching and latching the chair and thus the caregiver has some degree of control over the patient.

Figure 12:
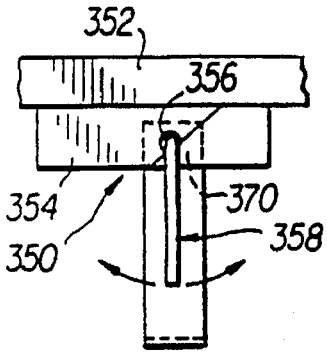
FIG. 12 is an enlarged side view of the latch shown in FIG. 11 with the latch in the unlatched mode.
Figure 13:
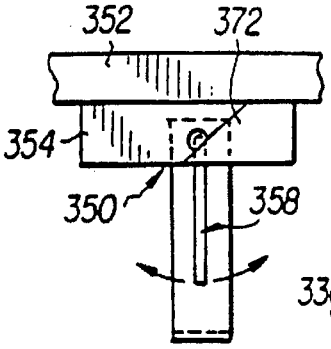
FIG. 13 is a view similar to FIG. 12 but showing the latch in a latched mode.
Figure 14:
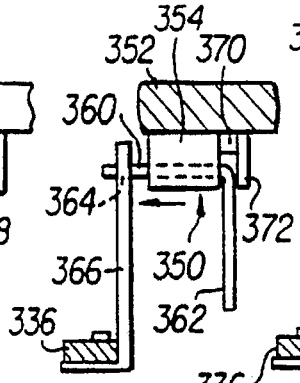
FIG. 14 is an end view of the latch of FIGS. 12 and 13 showing the latch in the latched mode of FIG. 12.
Figure 15:
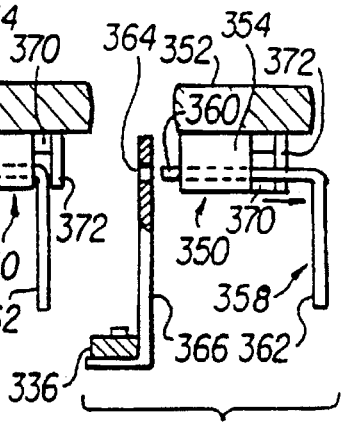
FIG. 15 is an end view similar to FIG. 14 but showing the latch in an unlatched mode.

Referring now specifically to FIGS. 12, 13 and 14, the latch 550 for latching the seat in the down position of FIG. 11 is shown in detail. The latch 350 is fixed to the lower rail 352 of the arm 20 (see FIG. 1). The latch 350 is comprised of a block 354 with a bore 356 therethrough in which is received an L-shaped latching pin 358. The L-shaped pin 358 has a shank 360 and a handle 362. When the latch is in the latched position, the shank 360 projects through a hole 364 in an L-shaped bracket 366 which is mounted to the frame 336 of the chair. When the latch is unlatched, the latching pin 358 is moved from the position of FIG. 14 to the position of FIG. 15 where the shank 360 is removed from the opening 364 in the L-shaped bracket 366. In order to hold the pin 358 in the latched position, the block 354 has a cutout 370. The cutout 370 is behind an angled wall 372 which holds the latch pin 358 in the latched position of FIGS. 13 and 14 but which allows the handle 358 to be rotated clockwise with respect to FIGS. 12 and 13. By rotating the handle 358 clockwise, it clears the wall. 372 and can be slid in the axial direction with respect to the shank 360 to the open position. When the handle 358 is then released, the handle is outside of the angled wall 372 as is seen in FIGS. 12 and 15 so as to not lock with the L-shaped bracket 366. Upon lowering the chair, the handle 362 can be rotated to clear the wall 372 and then pushed so that the shank 360 enters the opening 364 through the. L-shaped bracket 366. Upon again releasing the handle, the handle falls behind the wall 372 and is locked as is shown in FIGS. 13 and 15.

Figure 18:
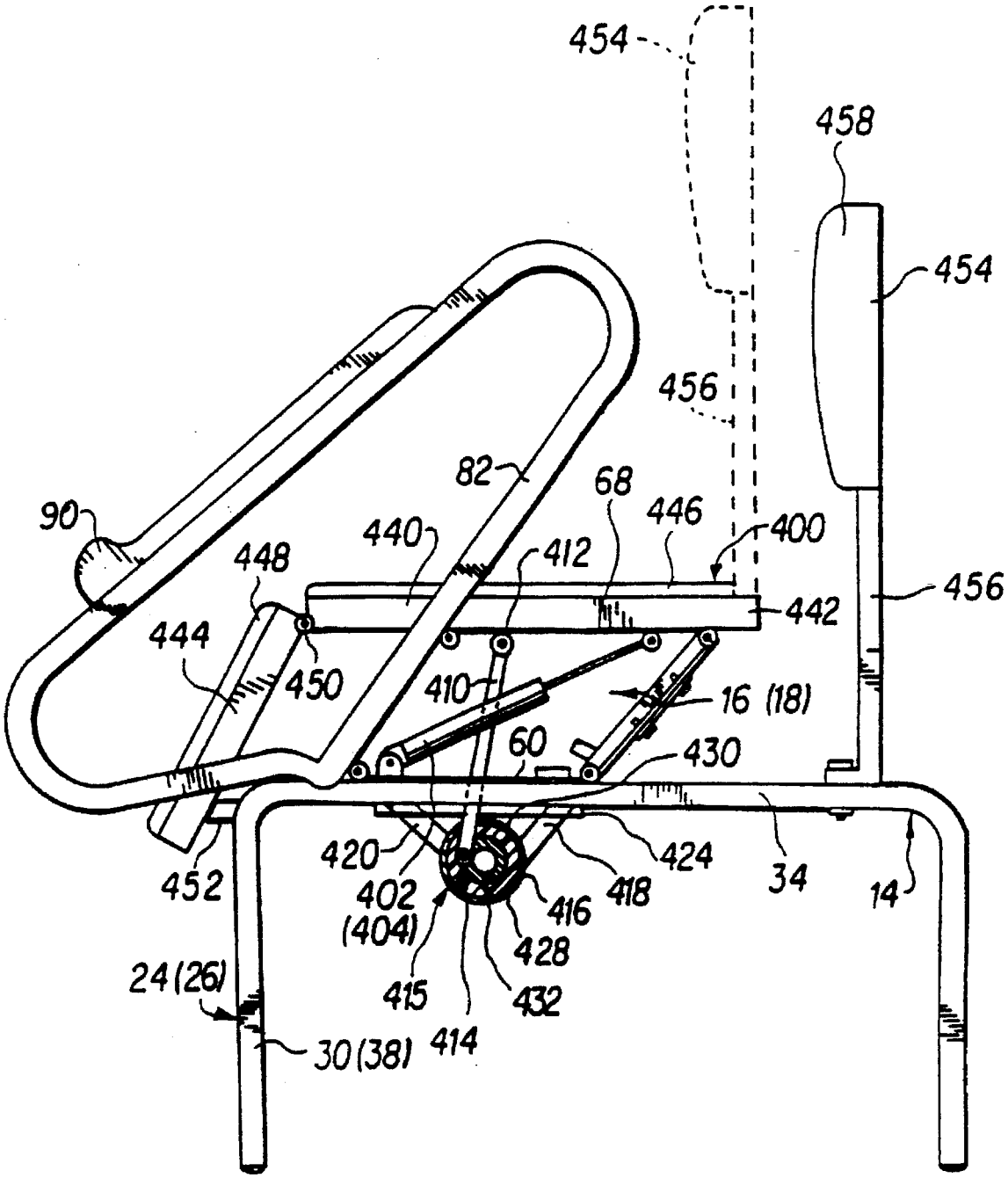
FIG. 18 is a side view of an additional embodiment of the invention wherein the lift seat is configured as a chair and showing the chair in a raised mode.
Figure 19:
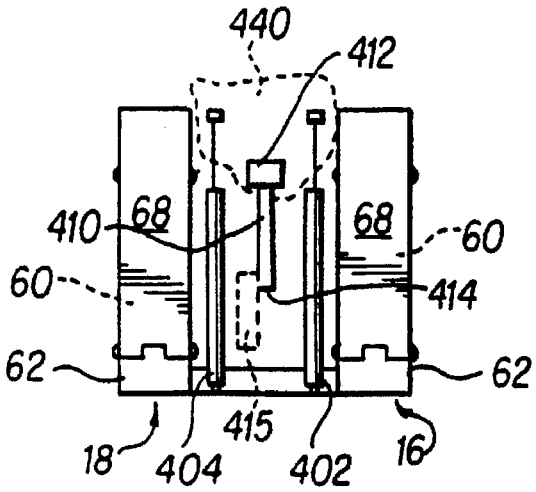
FIG. 19 is a top view of a portion of the additional embodiment of the invention showing a pair of dampers with a strut connected to an elastomeric spring disposed therebetween.
Figure 20:
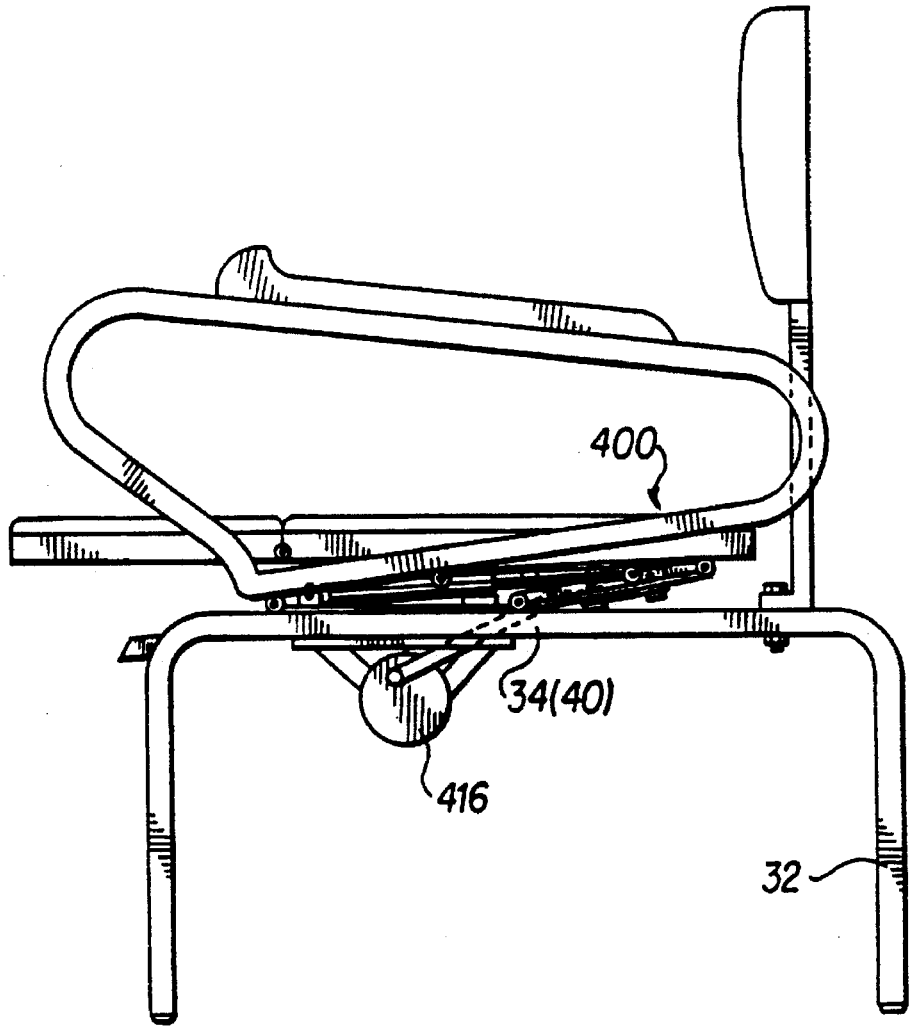
FIG. 20 is a side view similar to FIG. 18 but showing the chair in a lowered mode.

Referring now to FIGS. 18, 19 and 20, there is shown another embodiment of the invention wherein the invention is used as a regular chair which may be in a form similar to a lounge chair. In this embodiment, the frame members are substantially similar to the frame members of FIG. 1 as are the collapsible four-bar mechanisms 16 and 18. As is seen in FIG. 19, disposed between the four-bar linkages 16 and 18 are a pair of dampers 402 and 404. As is seen in FIGS. 18 and 20, the dampers 402 and 404 are pivoted at one end to the bottom links 60 of the four-bar linkage or to a cross-piece 405 rigid with the bottom links 60 and at the other end to the bottom of seat 440 which is rigid with top links 68 of the four-bar linkage. As the four-bar linkages 16 and 18 collapse and rise, the dampers 402 and 404 will provide damping and thus smooth the action.

Disposed between the dampers 402 and 404 is an arm 410. The arm 410 has a roller 412 at its upper end which engages the bottom surface of the seat 440 which is rigid with the links 68. The bottom end of the roller 412 is pivoted at pivot pin 414 to an annular elastomeric spring 415 available from the B. F. Goodrich Co. The annular elastomeric spring 415 has an outer casing 416 which is anchored by struts 418 and 420 to a plate 424 extending between the upper rails 34 and 40 of the side frames 24 and 26. Within the outer casing 416 there is a ring of elastomeric material 428 which is fixed to the outer ring 416 by a tab 430 of the elastomeric material. The elastomeric material 428 is bonded to an inner ring 432 to which the strut 410 is pivoted at the pivot pin 414.

The seat 440 is divided into first and second portions 442 and 444 which have pads 446 and 448 thereon. The second seat section 444 is pivoted to the first seat section 442 by a hinge 450. A strut 452 disposed between the front legs 30 and 38 of the chair 400 engages the bottom surface of the second seat portion 444 to support the second seat portion when the chair 400 is in the raised mode. The back rest 454 is mounted on the frame 14 of the chair by a resilient vertical strut 456. The back rest 454 has a padded portion 458 at the top thereof. Alternatively, the back rest 454 can be mounted on the rear of the first seat portion 442 of the chair with the strut 456 bolted thereto.

When a person sits in the chair 400, the chair collapses from the FIG. 18 to the FIG. 20 position, causing the dampers 402 and 404 to extend and the roller 412 on the strut 410 to roll along the bottom of the first seat portion 442 of seat 440. As the roller 412 rolls on the bottom of the first seat portion 442, the inner portion 432 of the elastomeric spring 414 rotates with respect to the outer portion 416 deforming the elastomeric material 428 and storing energy therein. The combination of the dampers 402 and 404 and deforming the elastomeric material 428 allows the seat 442 to lower gradually from the FIG. 18 to the FIG. 20 position. As this happens, the second portion of the seat 444 engages the backs of the person's thighs and pivots from the orientation of FIG. 18 to the substantially horizontal orientation of FIG. 20, thus providing full seating support for the occupant.

When the occupant decides to rise, pressure is placed against the handgrips 90 by the occupant and the occupant leans slightly forward, shifting weight on the first portion 442 of the seat. The deformed elastomeric material 428 is applying sufficient force to the strut 410 material to cause the roller 412 to roll against the bottom surface of the first seat portion 442, thus lifting the seat and its occupant from its FIG. 20 position back to its FIG. 18 position. As this happens, the second portion 444 of the seat pivots down, allowing the occupant to substantially straighten his or her legs in preparation for rising to the fully standing position.

From the foregoing description, one skilled in the art can easily ascertain the essential characteristics of this invention and, without departing from the spirit and scope thereof, can make various changes and modifications of the invention to adapt it to various usages and conditions.

I claim:

1. A lift seat for moving a person from an initial raised position to a subsequent lowered position for sitting and thereafter back to the initial raised position to facilitate standing, the lift seat comprising: a seating surface upon which the person sits and applies a force due to the weight of the person; a frame for supporting the seating surface; a linkage movable between a raised and lowered orientation, comprising first link means pivoted at one end to the seat and at another end to the frame and second link means spaced from the first link means, pivoted at one end to the seat and at another end to the frame; armrest means for supporting the person using the seat and for initiating operation of the seat, the armrest means being secured to one of the links; and spring means coupled to the linkage and frame for resisting lowering of the seating surface from the raised to the lowered position and for storing energy provided by the weight of the person sitting on the seat for subsequently lifting the person from the lowered to the raised position, the spring means comprising an annular elastomeric spring connected to an arm which engages the seat wherein as the seat collapses, the arm deforms the spring by twisting the spring to store energy therein.

2. The lift seat of claim 1, wherein the first link means is comprised of a pair of spaced front links, and the second link means is comprised of a pair of spaced rear links, the links being coupled to operate in unison.

3. The lift seat of claim 2, further including damper means coupled to the linkage for resisting movement of the linkage from a raised to a lowered position and from the lowered to the raised position.

4. The lift seat of claim 3, further including step means for preventing the linkage from collapsing in a first direction and for allowing the linkage to collapse in a second direction opposite the first direction.

5. The lift seat of claim 3, wherein the armrest means comprises a pair of armrests on opposite sides of the seating surface, the armrests being fixed to the front links and being pivoted therewith and wherein the spring means comprises a coil spring connected at one end to the frame and at the other end to the armrest, whereby when the armrest moves from a first position corresponding to the seat being raised to a second position corresponding to the seat being lowered, the spring is tensioned.

* * * * *